US006217351B1

(12) United States Patent
Fung et al.

(10) Patent No.: US 6,217,351 B1
(45) Date of Patent: Apr. 17, 2001

(54) ADAPTOR MODULE CONFIGURED TO BE ATTACHED TO A COMMUNICATION CARD

(75) Inventors: Jason Fung, Milpitas; Gary Wang, Cupertino, both of CA (US)

(73) Assignee: 3Com Corporation, Santa Clara, CA (US)

( * ) Notice: Subject to any disclaimer, the term of this patent is extended or adjusted under 35 U.S.C. 154(b) by 0 days.

(21) Appl. No.: 09/375,142

(22) Filed: Aug. 16, 1999

(51) Int. Cl.[7] ..... H01R 13/44; H01R 13/60
(52) U.S. Cl. ..... 439/131; 439/946
(58) Field of Search ..... 439/131, 945, 439/946, 638

(56) References Cited

U.S. PATENT DOCUMENTS

| | | | | |
|---|---|---|---|---|
| 5,375,037 | | 12/1994 | Le Roux | 361/684 |
| 5,391,094 | * | 2/1995 | Kakinoki et al. | 439/638 |
| 5,509,811 | | 4/1996 | Homic | 438/55 |
| 5,550,861 | * | 8/1996 | Chan et al. | 375/222 |
| 5,608,607 | | 3/1997 | Dittmer | 361/686 |
| 5,704,802 | * | 1/1998 | Loudermilk | 439/490 |
| 5,773,332 | | 6/1998 | Glad | 439/344 |
| 5,779,496 | * | 7/1998 | Bolinger et al. | 439/377 |
| 5,809,115 | * | 9/1998 | Inkinen | 379/93.05 |
| 5,876,218 | * | 3/1999 | Liebenow et al. | 439/946 |
| 5,973,925 | * | 10/1999 | Kraemer | 439/946 |
| 5,984,731 | * | 11/1999 | Laity | 439/946 |

OTHER PUBLICATIONS

Name of Author, Unknown, Title, About PCMCIA, Date Published, 1998.

Name of Author, Unknown, PC Card Technology Primer, Date Published, 1998.

Name of Author, Unknown, Title, Frequently Asked Questions About PC Card Technology, Date Published, 1998.

Name of Author, Unknown, Title, PCMCIA Bookstore, Date Published, 1998.

Name of Author, Unknown, Title, Miniature Card Technology Primer, Date Published, 1998.

Name of Author, Unknown, Title Xircom RealPort™ Integrated PC Card White Paper, Date Published, Unknown.

Name of Author, Unknown, Title, Xircom Trade–In Promotion, Date Published, Unknown.

Name of Author, Unknown, Title, RealPort™ LAN+WAN PC Card Frequently Asked Questions, Date Published, Unknown.

(List continued on next page.)

*Primary Examiner*—Brian Sircus
*Assistant Examiner*—Hae Moon Hyeon
(74) *Attorney, Agent, or Firm*—Workman, Nydegger & Seeley

(57) ABSTRACT

An adaptor module allows an electrical connection to be established between a communication system and a communication card. Advantageously, the adaptor module can be configured to provide an interface between the communication card and various communication systems such as conventional telephone systems, cellular telephone systems, digital telephone systems, local area networks (LANs), personal area networks (PANs) and wireless systems. In addition, the adaptor module can provide an interface between a plurality of communication systems and the communication card. For example, the adaptor module may provide an interface for a plurality of connectors from the same type of communication system and/or the adaptor module may provide an interface for connector, from different types of communication systems. Advantageously, the adaptor module can provide simultaneous communication with these various communication systems. The adaptor module is preferably configured to be attached to a standard PC card to facilitate communication between a computer and a communication system.

21 Claims, 7 Drawing Sheets

OTHER PUBLICATIONS

Name of Author, Bruce Brown, Title, Xircom RealPort CardBus Ethernet 10/100+Modem 56, Date Published Mar. 9, 1999.

Name of Author, Rob Schenk, Title, Leave Your Cables at Home With the Xircom RealPort, Date Published, Jan. 25, 1999.

Name of Author, Gareth Branwyn, Title, RealPort Ethernet 10/100+Modem 56, Date Published Sep. 30, 1998.

Name of Author, Emily Burg, Title, Investors Connect with Xircom, Date Published Jan. 13, 1999.

Name of Author, Mark A. Kellner, Title, Helping Road Warriors Drop Their Dongles, Date Published, Unknown.

Name of Author, Alan Goldstein, Title, Gadgets/Gizmos Attention: control freaks, Date Published, 1998.

Name of Author, Dan Seoane, Title, RealPort combines access choices, Date Published, Aug. 24, 1998.

Name of Author, Unknown, Title, PC Card Connector Life Cycle Analysis, Date Published, Unknown.

* cited by examiner

ADAPTOR MODULE CONFIGURED TO BE ATTACHED TO A COMMUNICATION CARD

BACKGROUND OF THE INVENTION

1. Field of the Invention

The present invention generally relates to electrical connectors and, in particular, to connectors for electrically coupling electrical devices and/or communication equipment to a computer.

2. Description of Related Art

Computers are widely used to perform a variety of different tasks and functions, and computers are frequently connected to other computers via communication systems and computer networks to allow information to be easily obtained and transmitted. In addition, portable computers are becoming more widely used because of their small size and easy portability. For example, portable computers are often used in the office and from airplanes, automobiles, hotels, home offices, etc. Therefore, there is a demand for reliable devices that allow portable computers to be connected to various computer systems and communication networks. Accordingly, a variety of different types of known electrical couplers have been developed to connect computers to various communication systems and computer networks. In general, these electrical couplers include a plug that is inserted into a corresponding jack. The jack typically includes an aperture or socket and an electrical connection is established when the plug is inserted into the jack.

Known electrical couplers are frequently designed for use with cards made according to specifications set forth by the Personal Computer Memory Card International Association (PCMCIA). These cards made in accordance with the PCMCIA specifications, often referred to as PC cards, provide compatibility between different types of computers and compute r manufacturers. As known, PC cards are typically inserted into corresponding slots or openings in a computer and the cards are electrically connected to the computer by a connector. Additionally, PC cards can be designed to perform various functions and a circuit board located within each card provides the necessary circuitry to perform the intended function.

Conventional PC cards have a thin, elongated rectangular body that is inserted into a corresponding slot in the computer. In particular, PC cards have a width of 54.0 mm, a length of 85.6 mm and a height that is dependant upon the type of card. For example, a Type I PC card has a height of 3.3 mm, a Type II PC card has a height of 5.0 mm and a Type III PC card has a height of 10.5 mm. Because PC cards only differ in height, a thinner card can be used in a thicker slot, but a thicker card cannot be used in a thinner slot. Additionally, PC cards have a 68-pin connector located at one end of the body and the connector is configured to be electrically coupled to the computer. The other end of the PC card typically includes an I/O connector configured to be coupled to communication system.

PC cards are frequently used because they allow a user to quickly and easily link a computer to a telephone system. For example, as shown in FIG. 1, a conventional adaptor assembly 10 is used to connect a telephone line 12 to a portable computer 14. The adaptor assembly 10 includes an electrical connector plug 16 that is inserted into an I/O connector of a PC card 20 and a line 22 connects an external module 24 to the connector plug 16. The external module 24 includes a housing 26 with an aperture 28 configured to receive an RJ-11 telephone jack 30 connected to an end of the telephone line 12. Disposed within the PC card 20 is a printed circuit board (PCB) that provides the necessary circuitry to perform the intended function of the PC card.

Disadvantageously, the conventional adaptor assembly 10 is awkward to use because it requires the use of both the PC card 20 and the separate external structure including the plug 16, line 22 and module 24 (frequently referred to as the "dongle"). If the dongle is lost or damaged, connection to the telephone line cannot be established. Thus, a new dongle must be purchased or the damaged dongle repaired, and this results in unnecessary delay and expense. Additionally, because the dongle is separate from the PC card, it requires additional space and it is susceptible to being dislodged from the computer. Further, the dongle is aesthetically displeasing and it is frequently damaged or broken because it extends outwardly from the body of the computer.

As shown in FIG. 2, another conventional device used for connecting a PC card to a telephone line is disclosed in U.S. Pat. No. 5,183,404 issued to Aldous, et al. and assigned to the same assignee as the present application. The Aldous patent, which is hereby incorporated by reference in its entirety, discloses a PC card 32 with a slidable thin plate 34. The plate 34 includes an aperture 36 adapted to receive a telephone jack and a plurality of contact pins 38. Each contact pin 38 has a first end that is freely exposed within the aperture and an opposed second end that is mounted to the thin plate 34. A first end of a flexible wire ribbon is connected to the second end of the contact pins and an opposing second end of the wire ribbon is connected to a circuit board within the PC card 32. The thin plate 34 is movable between an extended position and a retracted position. In the extended position, as shown in accompanying FIG. 2, the aperture 36 is exposed such that an RJ-11 telephone plug can be inserted. The plug (not shown) pushes against the contact pins 38 to establish electrical communication between the plug, contact pins, flexible wire ribbon and the PC card. When not in use, the plug is removed from the aperture 36 and thin plate 34 is retracted within the PC card 32.

As shown in FIG. 3, another known device used to attach a standard telephone jack to a PC card is disclosed in co-pending U.S. patent application Ser. No. 09/271,620, filed Mar. 17, 1999, listing Oliphant, et al. as inventors and assigned to the same assignee as the present application. The Oliphant application, which is hereby incorporated by reference in its entirety, discloses a PC card 40 with a physical/electrical modular connector 42 that is configured to physically and electrically couple an RJ-11 telephone jack to the PC card. More specifically, the physical/electrical modular connector 42 includes a jack 44 that is mounted to a slide plate 46 which is movable between an extended position wherein an aperture 48 is configured to receive a telephone plug and a retracted position wherein the slide plate is positioned within the PC card 40. The jack 44 includes a number of contact pins 50 that are configured to be electrically connected to a telephone plug inserted into the aperture 48. The contact pins 50 are electrically connected to the PC card 40 when the jack is in the extended position and the pins are insulated from electrical connection with the PC card when the jack is in the retracted position.

A conventional device used to connect a PC card to a telephone line is also disclosed in U.S. Pat. No. 5,509,811 issued to Homic. The Homic patent discloses an RJ-11 telephone socket that is physically and electrically connected to a PCMCIA modem card which is recessed a predetermined distance "X" within the computer housing. The telephone socket and the modem card are mechanically and physically connected by a connector block. The connector block includes a body portion that is mounted flush to the exterior surface of the computer enclosure and an end cap which protrudes downwardly and outwardly from the body portion. The end cap has a thickness "X" that is the same as the predetermined distance "X" that the modem card is recessed into the computer so that the exterior surface of the modem card is flush with the outer surface of the computer housing. Disadvantageously, this device requires that the modem card be recessed a predetermined distance "X" inside the body of the computer and it allows only a single RJ-11 telephone jack to be connected to the modem card. Thus, the modem assembly cannot be coupled to other type of connectors or communication systems. Additionally, because the RJ-11 telephone socket is integrally connected to the modem card and both the modem card and the connector block are recessed inside the computer, neither the modem card nor socket is readily repairable or replaceable.

Another conventional device used to connect a PC card to a telephone line is disclosed in U.S. Pat. No. 5,608,607 issued to Dittmer. The Dittmer patent discloses a structure this is inserted into dual PCMCIA card slots. The structure includes an attachment section that is removably connected to the PCMCIA card and a support body that is secured to the attachment section. The attachment section has a shape similar to the PCMCIA card and this section is positioned in a parallel, facing and closely adjacent relationship with the PCMCIA card. The Dittmer patent, however, only discloses a socket for a standard RJ-11 telephone plug and a socket for a standard cellular telephone connector plug in the attachment section. Thus, the usefulness of the device is limited because it can only be connected to a conventional telephone system or a cellular telephone system by standard plugs.

As shown in FIG. 4, yet another conventional device used to connect a PC card to a telephone line is an adaptable communication connector disclosed in U.S. Pat. No. 5,773,332 issued to Glad. The communication connector disclosed in the Glad patent includes a communications card with the dimensions and configuration of a Type III PC card. The communication card 52 includes two sockets 54 and 56 with T-shaped cutout sections 58 and 60, respectively, located in the upper surface of the card 52. These cutout sections 58 and 60 are sized and configured to engage the biased clip 62 and ridge 64 of a conventional RJ-type communication plug 66. Disadvantageously, the cutout sections 58 and 60 are sized and configured to receive only conventional RJ-type communication plugs and the card cannot be reconfigured to be coupled to other types of communication systems.

SUMMARY OF THE INVENTION

A need therefore exists for an adaptor module that provides access to various computer systems and communication networks without the above-described disadvantages and problems.

One aspect of the present invention is an adaptor module that provides reliable, easy-to-use access to various computer systems and communication networks. Advantageously, the adaptor module can be used with different types of connectors to provide access to various communication systems such as conventional telephone systems, local area networks (LANs), Ethernet, cellular telephones, wireless networks, and other suitable networks and systems.

Another aspect is an adaptor module that allows communication to be established between a computer and two or more communication systems. For example, the adaptor module may provide an interface that allows communication with a telephone network and/or a LAN to be established. In particular, the module may include an RJ-11 jack for connection to a telephone network and an RJ-45 jack for connection to a LAN. The adaptor module may also include other types of connectors such as multiple pin interfaces and/or universal serial buses (USBs) to allow electrical communication with various peripheral devices or communication systems to be established. Alternatively, the adaptor module may include two or more connectors that are connectable to the same or different types of communication systems. Advantageously, the adaptor module can provide simultaneous communication with two or more communication systems.

Still another aspect is an adaptor module that provides an interface for use with electronic devices such as a personal computers (PCs), portable computers, laptop computers, notebook computers and palmtop computers. The adaptor module can also be used with other types of electronic devices such as cellular telephones, personal data assistants (PDAs), personal information managers (PIMs) and the like.

Yet another aspect is an adaptor module that is releasably attached to a PC card by one or more clips. The clips may be positioned in any desired location and the clips permit, for example, one adaptor module to be easily interchanged with another module having a different configuration. In a preferred embodiment, the clips include one or more extensions that are releasably connected to one or more corresponding apertures. The extensions and apertures, for example, may be located on the front and back surface or sides of the adaptor module and PC card.

Advantageously, if an adaptor module is not attached to the PC card, the PC card functions as a regular PC card. Thus, the PC card can perform its normal functions and known cables and other types of connectors can be used to connect the PC card to communication systems such as LANs, modems, etc. On the other hand, if the adaptor module is attached to the PC card, the adaptor module provides additional circuitry and connectors to permit additional features and functions to be performed. Desirably, the host computer recognizes if the adaptor module is attached to the PC card and the computer determines the configuration and capabilities of the adaptor module and PC card assembly.

A further aspect is an adaptor module that is permanently or integrally attached to a PC card to form a one-piece unit. Advantageously, the one-piece unit is easy to use because it can be simply inserted into PC card slot in a computer. Additionally, the integral unit has no moving parts to break and it is fully integrated for convenience. Further, the adaptor module and PC card may contained within a single housing and the electrical components may be directly connected.

Another aspect is an adaptor module that can be inserted into standard sized PC card slots in a computer. In particular, the PC card is preferably a Type II card and the adaptor module preferably has dimensions that are the same as or smaller than a Type II PC card. Thus, the connected adaptor module and PC card are preferably sized and configured to be inserted into dual or aligned Type II PC card slots or a Type III PC card slot. Alternatively, all or a portion of the adaptor module may be located external to the PC card slot and/or computer. For example, the adaptor module may be hingably attached to the PC card and the adaptor module may be located exterior to the PC card slot, or the adaptor may be spaced from the PC card and interconnected by a cable.

Yet another aspect is an adaptor module with a connector on a lower surface which is configured to be electrically coupled to a connector on an upper surface of a PC card. In particular, the lower surface of the adaptor module includes one or more contacts such as spring pins or surface pads which are configured to engage one or more contacts such as fingers or extensions on the upper surface of the PC card to establish electrical communication. Advantageously, the connectors on the adaptor module and PC card can be any suitable type of male/female connects that allow electrical communication to be established between the adaptor module and PC card. Alternatively, the contacts could be positioned on an upper surface of the adaptor module and on the lower surface of the PC card. Additionally, the adaptor module may include one or more contacts that are configured to be electrically coupled to contacts on a front surface of a PC card.

Another aspect is an adaptor module that includes one or more indicators, such as incandescent lights or light emitting diodes (LED), that indicate use or mode of operation of the adaptor module. The indicators may also be used for other purposes such as installation and repair of the adaptor module. The indicators are preferably positioned on a front face of the adaptor module to facilitate viewing of the indicators by the user.

A further aspect is an adaptor module that includes an antenna for wireless communication. The antenna may be configured, for example, for cellular telephone communication, digital telephone communication, wireless LANs, radio communication, etc. The adaptor module may also contain a recess to hold the antenna when not in use and the module may contain circuitry used by the antenna such as a radio frequency (RF) adaptor. Advantageously, the adaptor module may be configured to provide both wireless and wired communication.

Advantageously, the adaptor module provides additional ports and circuitry to a PC card. This allows for further product development, future expansion and additional options to the user. Significantly, if the adaptor module is releasably attached to a PC card, the user can readily use the PC card by itself or interchange the adaptor modules. This increases the flexibility and options available to the user because, for example, the computer can easily be connected to various communication systems by different types of connectors.

In a preferred embodiment of the present invention, an apparatus facilitates communication between an electrical device and a communication system. The apparatus includes a communication card having a generally rectangular body with an upper surface. lower surface, front surface, rear surface, left surface and right surface. The communication card is configured to be at least partially inserted into an opening in the electrical device and a coupling is located on an upper surface of the communication card. An adaptor module is connected to the communication card and the adaptor includes one or more connectors capable of being electrically connected to a communication system. The adaptor module also includes a bottom surface with a coupling which is configured to be electrically connected to the coupling on the upper surface of the communication card. Preferably, the coupling on the bottom surface of the adaptor module includes one or more spring pins which are configured to engage one or more fingers in the coupling on the upper surface of the communication card.

In this preferred embodiment, the one or more connectors are preferably located on the front surface of the adaptor module and the connectors are sized and configured to receive RJ-type connectors such as RJ-11 or an RJ-45 type connectors. Alternatively, the connectors may include multiple pin interfaces, universal serial buses (USBs), cable connectors or other type of input/output connectors. Additionally, the adaptor module is preferably releasably connected to the communication card by clips. The clips are inserted into slots near the front and back surfaces of the communication card. The clips are releasable, for example, to allow different adaptor modules to be attached to the communication card.

In another preferred embodiment, an adaptor module is configured to be electrically coupled to a communication card. The adaptor module includes an elongated body with top, bottom, front, rear and side surfaces; a coupling attached to an outer surface of the body and two connectors located on the front surface of the body, each of the connectors being sized and configured to receive a communications connector. The adaptor module desirably includes one or more indicators attached to the front surface of the body to provide information to a user and a plurality of clips for releasably attaching the adaptor module to the communication card.

In still another preferred embodiment, an interface between a communication connector and a communication card for an electrical device includes a body with top, bottom, front, rear and side surfaces; and a plurality of receiving portions positioned in the front surface of the body portion, each of the receiving portions configured to receive a communication connector. The interface also includes a coupling on the lower surface of the body configured to be electrically connected to a coupling on the upper surface of the communication card. The interface is preferably releasably attached to the communication card by clips located proximate the front and rear surfaces of the interface and the assembly is desirably sized and configured to fit into dual Type II PC card slots or a Type III PC card slot.

In another preferred embodiment, an electrical coupling system for establishing communication between a computer and a communication system includes an adaptor module including one or more receiving portions, each of the receiving portions configured to be releasably coupled to a communication plug. The adaptor module is configured to be electrically connected to a communication card through a communication port. The adaptor module preferably includes one or more indicators to provide information to a user and the module is preferably releasably connected to the communication card such that the communication card can be used by itself or in combination with the adaptor.

In yet another preferred embodiment, an adaptor module establishes an electrical connection with a communication card. The adaptor module includes a body with a communication port in an outer surface configured to be electrically coupled to a communication port in an outer surface of the communication card. The adaptor module also includes a plurality of clips that are sized and configured to be releasably connected to a plurality of apertures in the communication card to facilitate attachment of the adaptor module to the communication card. One or more connectors in the body of the adaptor allow electrical connection to one or more communication networks. For example, one connector may be configured to receive an RJ-11 type plug and another connector may be configured to receive an RJ-45 type plug.

Advantageously, the adaptor module is easy-to-use and provides an interface that can be quickly and conveniently connected to different communication cards and to a variety of communication systems. The adaptor module is also reliable, flexible and provides a variety of options to the user. In addition, the adaptor module is compatible with a wide variety of computers, operating systems, etc. Further, the adaptor module may be used to provide connection to a communication network at any time and from any suitable location. Finally, the adaptor module preferably does not include any moving parts and that increases the useful life of the module.

Further aspects, features and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other aspects, features and advantages of the invention are obtained, a more particular description of the invention briefly described above will be rendered by reference to specific embodiments that are illustrated in the appended drawings. Understanding that these drawings depict only typical embodiments of the invention and are not to be considered to be limiting of its scope, the invention will be described and explained with additional specificity and detail through the use of the accompanying drawings in which.

DETAILED DESCRIPTION OF THE PREFERRED EMBODIMENTS

The present invention involves an adaptor module that allows communication between a communication system and an electrical device such as a computer to be established. The principles of the present invention, however, are not limited to adaptor modules for computers. It will be understood that, in light of the present disclosure, the adaptor module disclosed herein can be successfully used in connection with other types of electronic devices such as cellular telephones, digital telephones, personal data assistants, personal information managers and the like.

Additionally, to assist in the description of the adaptor module, words such as top, bottom, front, rear, right and left are used to describe the accompanying figures. It will be appreciated, however, that the present invention can be located in a variety of desired positions—including various angles, sideways and even upside down.

Further, one skilled in the art will recognize that the various components described in connection with the preferred embodiments may be placed in different positions and locations. Thus, for example, the various connectors, contacts, receiving portions, communication ports, adaptor modules, communication cards, clips and apertures may be positioned in any desired location.

Finally, it will be understood that in the following description numerous details are set forth, such as specific types of communication connectors or plugs, specific numbers of pins and electrical contacts, particular types of communication cards, etc., to provide a thorough understanding of the present invention. One skilled in the art will recognize, however, that the adaptor module may be used in conjunction with various communication systems, networks, connectors, plugs, contacts, receiving portions, communication cards, ports, etc.

Figure 1:
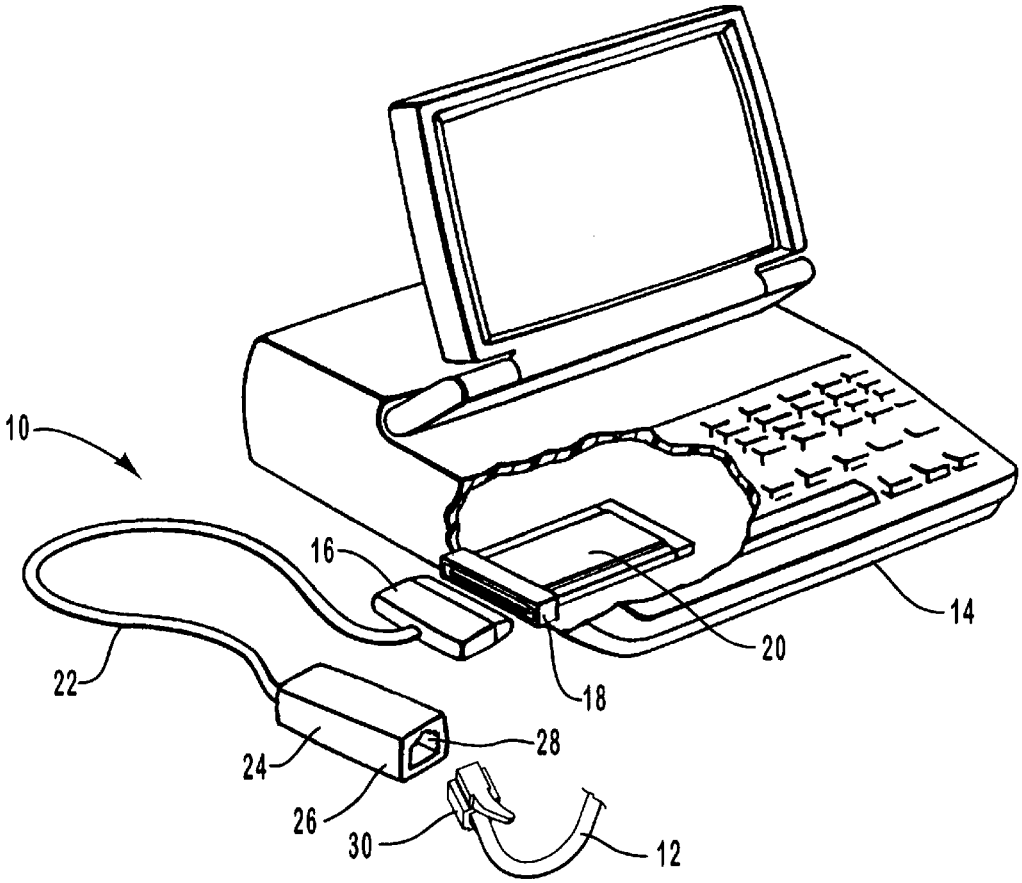
FIG. 1 (PRIOR ART)
FIG. 1 is a perspective view of a known device for connecting a computer to a telephone line using a PC modem card.
Figure 2:
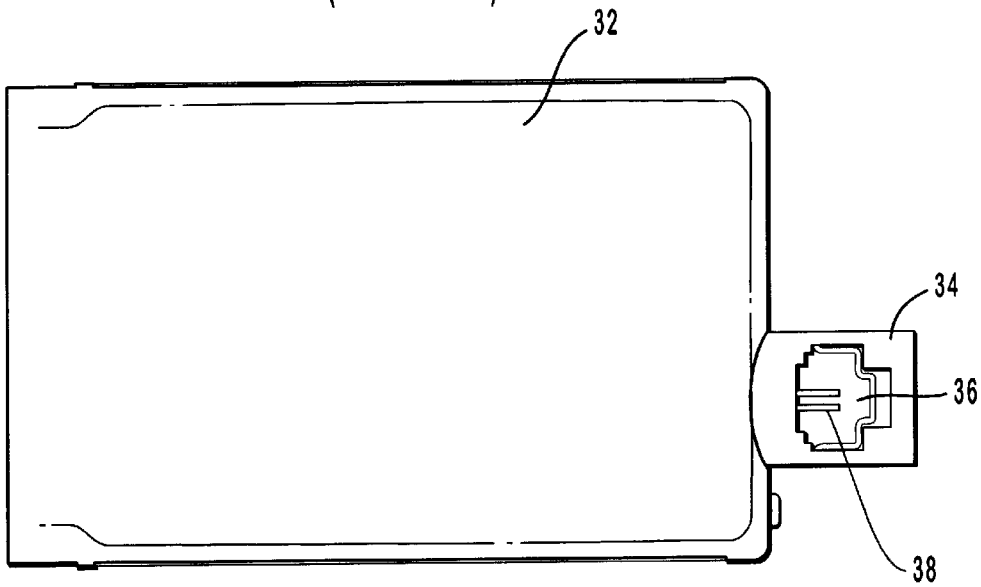
FIG. 2 (PRIOR ART)
FIG. 2 is a top plan view of another known device for connecting a computer to a telephone line using a PC modem card.
Figure 3:
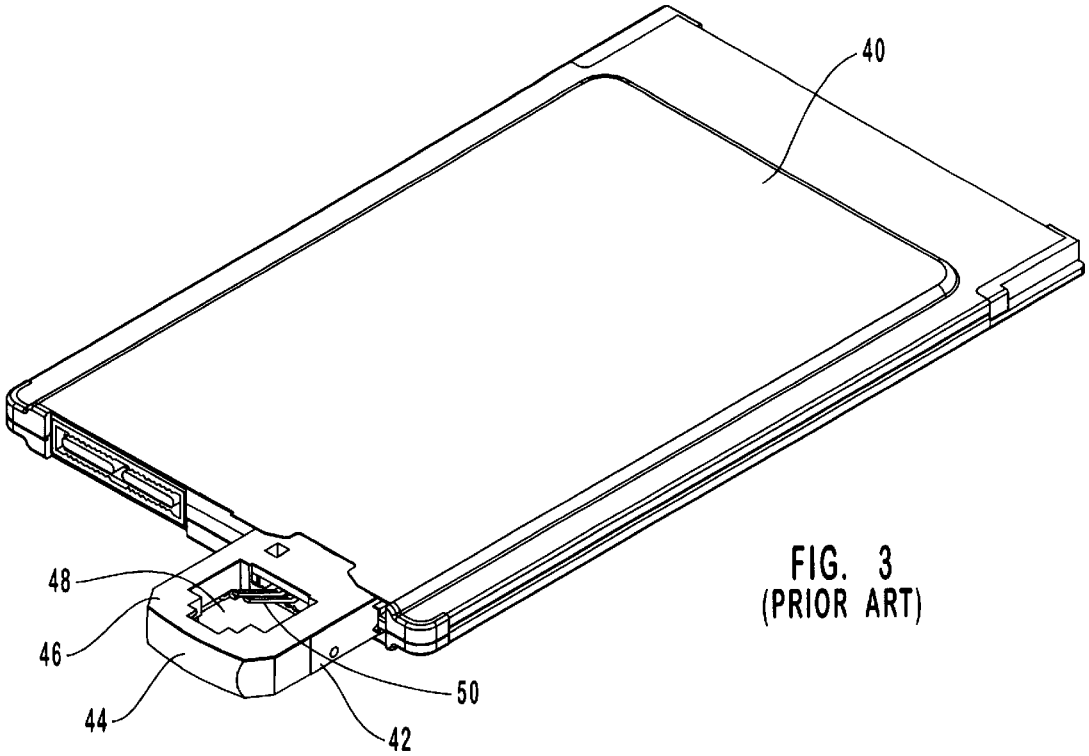
FIG. 3 (PRIOR ART)
FIG. 3 is a perspective view of still another known device for connecting a computer to a telephone line using a PC modem card.
Figure 4:
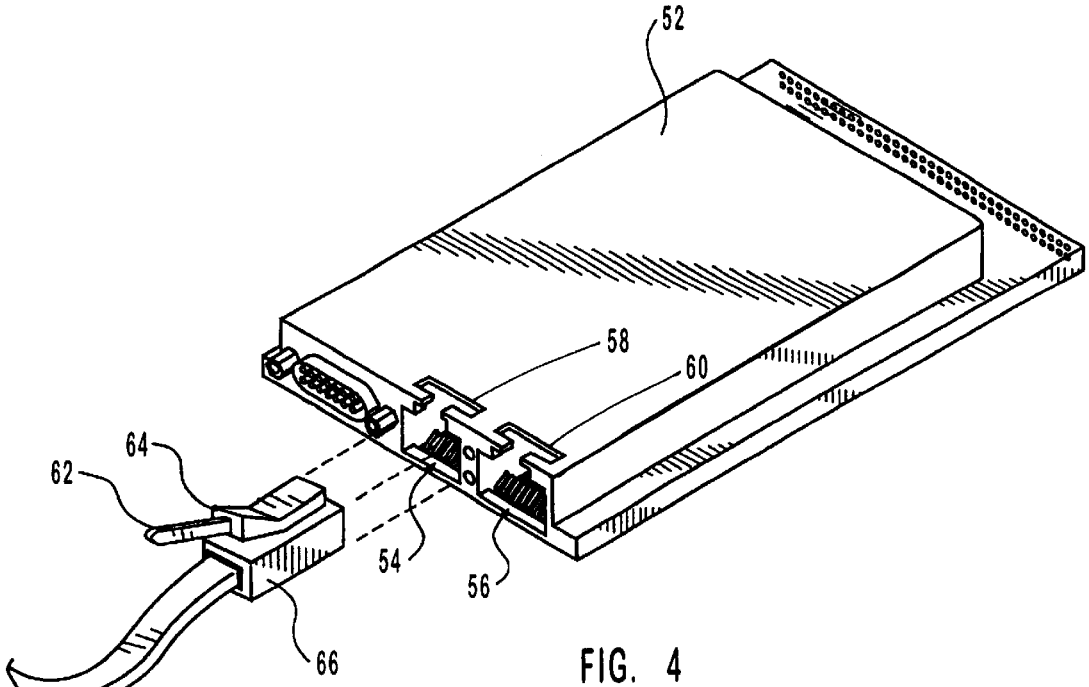
FIG. 4 (PRIOR ART)
FIG. 4 is a perspective view of yet another known device for connecting a computer to a telephone line using a PC modem card.
Figure 5:
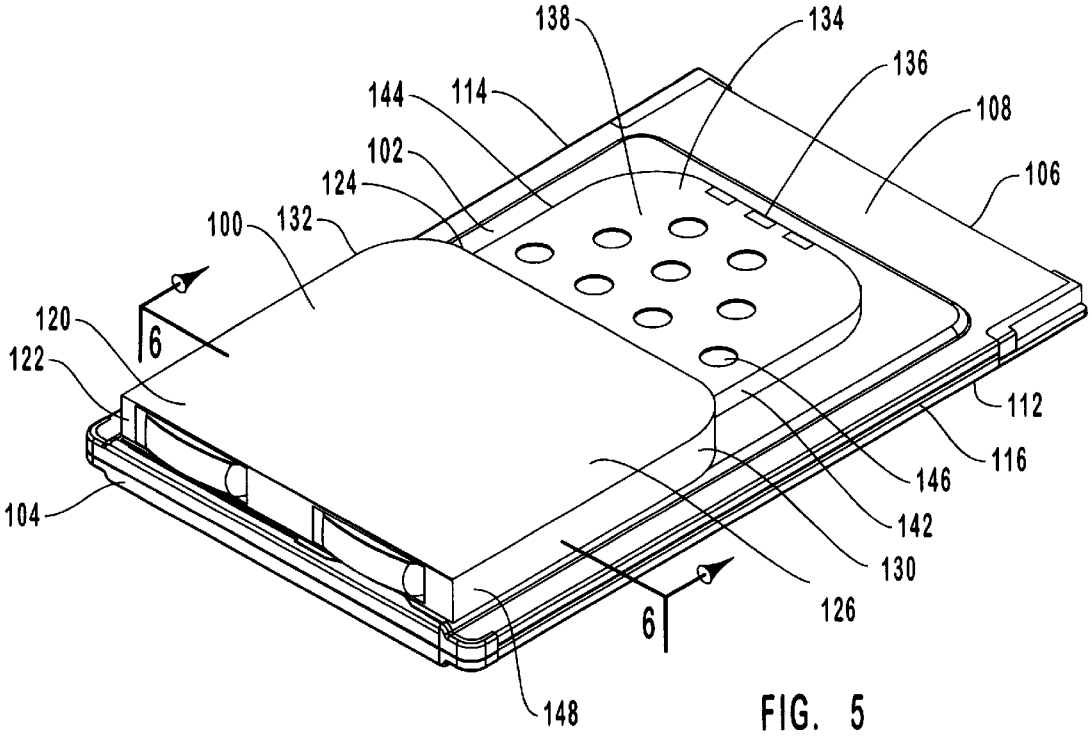
FIG. 5 is a perspective view of an adaptor module in accordance with a preferred embodiment of the present invention, illustrating the adaptor module connected to an exemplary PC card.

As shown in FIG. 5, an adaptor module 100 is attached to a communication card 102 in accordance with a preferred embodiment of the present invention. As discussed in greater detail in connection with FIG. 13, the adaptor module 100 is preferably releasably attached to the communication card 102. Thus, if the adaptor module 100 is not connected to the card 102, then the card desirably functions according to its normal operation. On the other hand, if the adaptor module 100 is connected to the card 102, then the adaptor module provides additional circuitry and connectors such that the assembly can perform additional features and functions. Alternatively, as discussed in connection with FIG. 14, the adaptor module 100 and communication card 102 can be integrally connected to form a one-piece unit.

The adaptor module 100 and communication card 102 are preferably sized and configured to be connected to a portable computer such as a laptop computer, notebook computer, hand-held computer or palmtop computer. The module 100 and card 102, however, can be used with any suitable computer or electronic device such as cellular telephones, digital communication systems, personal data assistants and the like. Preferably, the communication card 102 complies with applicable specifications set forth by the Personal Computer Memory Card International Association (PCMCIA). More preferably, the communication card 102 is a Type II compatible PC card. Specifications regarding PC card technology are described in detail in the PC Card Standard published by PCMCIA, which is available from the PCMCIA international headquarters in San Jose, California or from the PCMCIA Internet web site www.pc-card.com. The PC Card Standard, which provides physical, electrical and software specifications for PC card technology, is hereby incorporated by reference in its entirety. It will be understood, however, that while the adaptor module 100 and communication card 102 are described with respect to PC card specifications, the adaptor module may be used with other types of circuit cards and adaptor cards such as small PC cards, miniature cards, compact flash cards, smart media cards, multimedia cards, etc. Additionally, while these cards are preferably a miniature type, any suitable size of card may be used.

In greater detail, the communication card 102 has a thin, elongated body with a front surface 104, rear surface 106, top surface 108, bottom surface 110, right side 112 and left side 114. The card 102 has a length of about 85.6 mm (3.4 inches), a width of about 54.0 mm (2.1 inches) and a thickness of about 5.0 mm (0.2 inches), but the card may have any suitable dimensions. The card 102 is configured to be inserted into a PC card slot in a computer and it includes a connector such as a 68-pin connector (not shown) in the rear surface 106 of the card which is configured to be electrically connected to the computer. The front surface 104 of the card 102 may include one or more connectors that can be coupled to peripheral devices such as a communication network. Located within the body of the card 102 is circuitry which connects the connectors on the front surface 104 of the card with the 68-pin connector in the rear surface 106 of the card. The circuitry allows the intended functions of the card, such as modem functions, to be performed. The right side 112 and left side 114 of the card 102 include outwardly extending rails 116 and 118, respectively, that are used to position the card in the PC card slot in the computer.

The adaptor module 100 includes a body 120 with a front surface 122, rear surface 124, top surface 126, bottom surface 128, right side 130 and left side 132. Extending from the rear surface 124 of the body 120 is an extension 134 with a rear surface 136, top surface 138, bottom surface 140, right side 142 and left side 144. As seen in the accompanying figures, some of these surfaces and sides are rounded and tapered. It will be understood that the adaptor module and extension can have any suitable shape or configuration, including rounded, tapered or curved sides, ends, comers, etc. The top surface 138 of the extension 134 includes a plurality of openings 146, but the openings are not required. The body 120 and the extension 134 are preferably integrally formed as a single unit, but the body and the extension could be constructed from separate components.

The adaptor module 100 preferably has a height of about 5.0 mm (0.2 inches) or less, a width of about 54.0 mm (2.1 inches) or less, and a length of about 85.6 mm (3.4 inches) or less such that the adaptor module 100 fits within a Type II compatible PC card slot. One skilled in the art, however, will appreciate that the module 100 may have any desired dimensions depending, for example, upon the type of communication card and intended use of the module. As shown in FIG. 5, the bottom surfaces 128 and 140 of the body 120 and extension 134, respectively, are generally parallel and positioned proximate the top surface 108 of the card 102. It will be understood that the top surfaces 126 and 138 of the module 100 and extension 134, respectively, could also be positioned generally parallel and proximate the bottom surface 110 of the card 102.

Desirably, the adaptor module 100 and communication card 102 are sized and configured to be inserted into two stacked Type II PC card slots or a Type III PC slot. As shown in FIG. 5, the communication card 102 and adaptor module 100 are positioned generally parallel to each other and the front surfaces 104 and 122 of the module and card, respectively, are aligned. The adaptor module 100 and communication card 102, however, may be spaced apart or positioned at any desired angle. Additionally, the module 100 and card 102 may be recessed into the body of the computer or configured to extend outwardly from the body of the computer.

Figure 6:
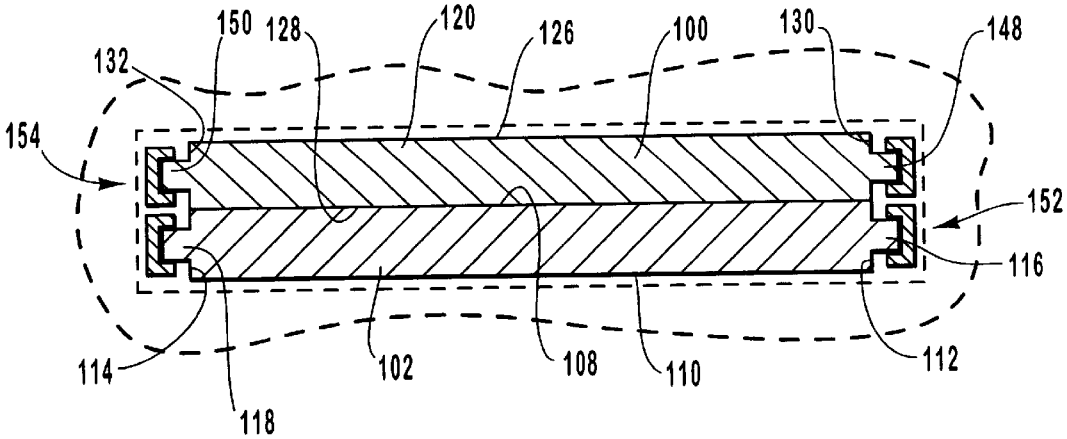
FIG. 6 is a cross sectional side view of an adaptor module in accordance with another preferred embodiment of the present invention, illustrating the adaptor module positioned adjacent to an exemplary PC card.
Figure 7:
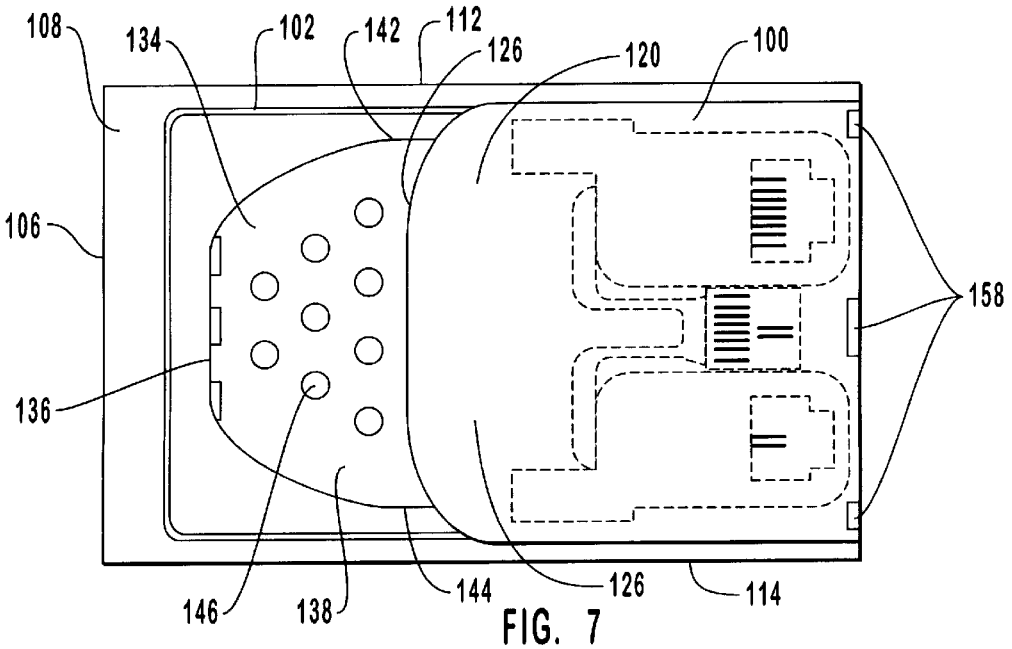
FIG. 7 is a top plan view of the adaptor module and PC card shown in FIG. 5, illustrating exemplary connectors in a retracted position.

The communication card 102 is held inside a PC card slot in a computer by rails 116 and 118 that protrude outwardly from the sides of the card. In particular, the rails 116 and 118 are configured to be inserted into receiving notches or C-shaped portions in the PC card slot such that the card 102 is securely held within the slot. The adaptor module 100 is held within the PC card slot because the module is connected to the communication card 102. Alternatively, as seen in FIG. 6, the adaptor module 100 may include rails 148 and 150 that extend outwardly from the right side 130 and the left side 132, respectively, of the body 120. The rails 116 and 118 of the card 102 and the rails 148 and 150 of the body 120 are configured to be inserted into receiving members 152 and 154. The receiving members 152 and 154 have a generally C-shaped cross-section and are sized and configured to slidably receive the rails 116, 118, 148 and 150.

Figure 13:
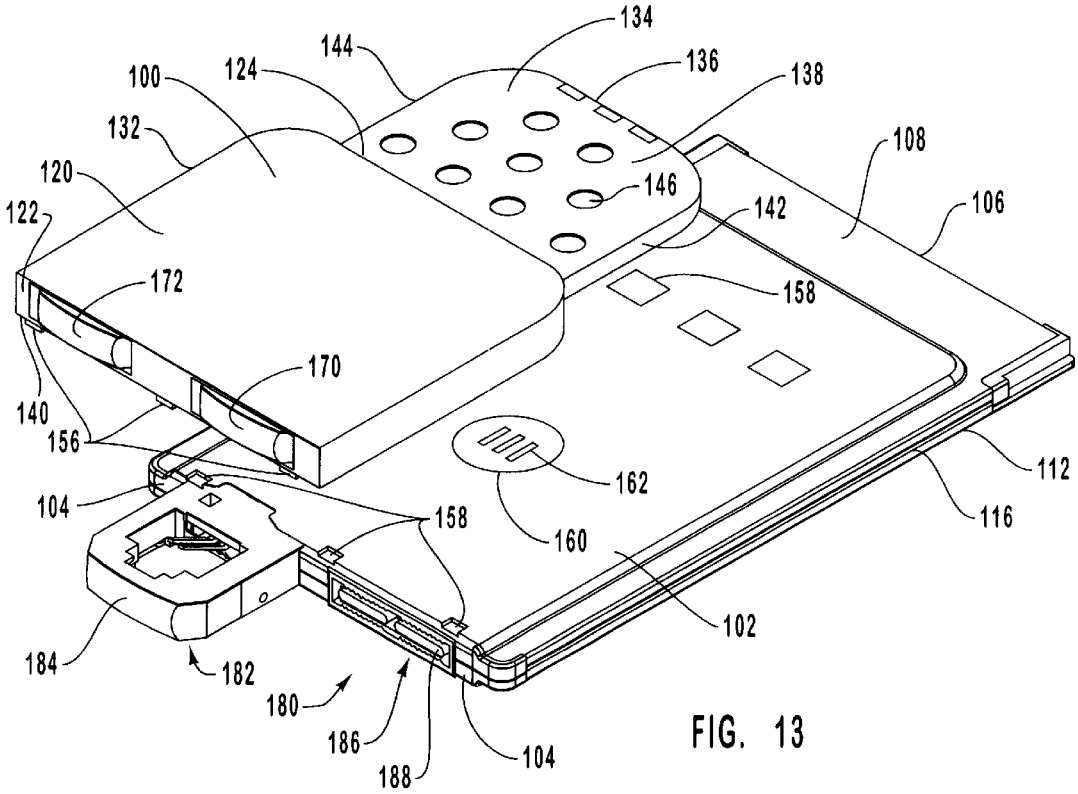
FIG. 13 is an exploded perspective view of the adaptor module in accordance with another preferred embodiment of the present invention.

In a preferred embodiment, as best seen in FIG. 13, the adaptor module 100 is releasably attached to the card 102 by one or more attachment members or clips 156 that are inserted into corresponding openings or apertures 158 in the card 102. The attachment members 156 are preferably sized and configured to engage the apertures 158 to prevent the unintended removal of the module 100 from the card 102. For example, the attachment members 156 may be held in the apertures 158 by a friction or interference fit, or the attachment members may include a curved or expanded portion which engages an inner portion of the aperture. Although the attachment members 156 and apartures 158 shown in the accompanying figures are located on the front surface of the adaptor module 100 and communication card 102, respectively, it will be understood that the attachment members and apartures can be placed in any desired location on either the module or card. One skilled in the art will appreciate that there are numerous known ways in which the adaptor 100 can be releasably or permanently attached to the card 102. For example, the adaptor 100 can be attached to the card 102 by various latches, catches, clasps, adhesives, etc. Advantageously, the releasable attachment of the module 100 to the card 102 allows different modules with different configurations to be readily attached to the card. Additionally, because the adaptor module 100 is releasably attached to the card 102, the module can be quickly and easily removed for repair or replacement.

As seen in FIG. 13, the top surface 108 of the communication card 102 includes a coupling or port 160. The coupling 160 includes one or more contacts 162 such as outwardly extending fingers or surface pads that are electrically connected to circuitry located within the card 102. The bottom surface 128 of the adaptor module 100 includes a coupling or port 164 and the coupling includes one or more contacts 166. The contacts 16o are preferably spring pins or surface pads that are configured to engage the outwardly extending fingers 162 on the upper surface 108 of the card 102. One skilled in the art will recognize any desired type of connectors may be used to couple the adaptor module 100 to the communication card.

The engaged fingers 162 and spring pins 166 allow electrical communication between the adaptor module 100 and card 102 to be established. In greater detail, the fingers 162 and spring pins 166 have mating surfaces that provide high contact quality with low wear and abrasion characteristics. Additionally, the fingers 162 and spring pins 166 may be plated with materials such as gold to decrease contact resistance. It will be understood that the couplings 160 aid 164 may also be electrically connected by an extension, cable or other suitable type of connector. It will also be understood that the coupling 160 may be located on the front surface 104 of the communication card 102 and the coupling 164 may be located on the front surface 122 of the adaptor module 100, or any other suitable locations.

The front surface 122 of the adaptor module 100 shown in FIG. 13 includes a pair of receiving portions or connectors 170 and 172. The connectors 170 and 172 are preferably input/output (I/O) ports that allow one or more peripheral devices to be coupled to the adaptor module 100. As shown in the accompanying figures, the connectors 170 and 172 are preferably slidable connectors such as XJACK® connectors available from the 3COM Corporation of Santa Clara, Calif., the assignee of the present application. Exemplary slidable connectors are disclosed in Assignee's co-pending U.S. patent application Ser. No. 09/271,620, entitled Electrical Connectors Having Dual Based Contact Pins, filed Mar. 17, 1999, listing Oliphant et al. as the inventors. The ports 170 and 172 may also include an electrical interface and configuration as disclosed in Assignee's co-pending U.S. patent application Ser. No. 08/976,199, entitled Breakaway Physical/electrical Media Jack, filed Nov. 21, 1997, listing Garside as the inventor; or Assignee's co-pending U.S. patent application Ser. No. 08/976,819, entitled Media Connector Interface for Electrical Apparatus, filed Nov. 24, 1997, listing Beckham, et al. as the inventors. Another example of a slidable connector is disclosed in Assignee's co-pending U.S. patent application Ser. No. 09/033,270, filed Mar. 2, 1998. These pending applications are hereby incorporated by reference in their entirety. One skilled in the art will recognize that the adaptor module 100 may include any suitable type of ports or connectors such as multiple pin interfaces, USBs, pass-through ports, etc.

Figure 8:
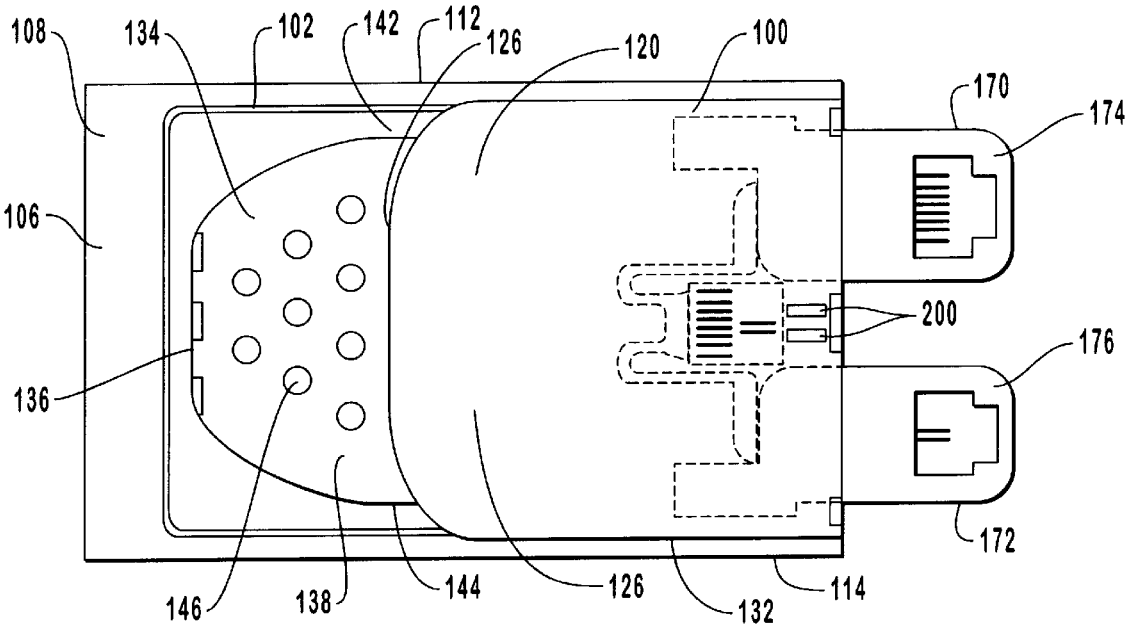
FIG. 8 is a top plan view of the adaptor module and PC card shown in FIG. 5, illustrating the exemplary connectors in an extended position.

In greater detail, as seen in FIG. 8, the connector 170 is a slidable connector 174 and the connector is preferably sized and configured to receive a RJ-type connector such as an RJ-11 connector. The connector 172 is also a slidable connector 176 and this connector is preferably sized and configured to receive a RJ-type connector such as an RJ-45 connector. Thus, the connectors 170 and 172 allow the adaptor module 100 to be connected to communication systems such as a telephone network and/or a LAN. Preferably, the module 100 is configured to provide simultaneous communication with one of more communication systems, but the module can also be configured to communicate with only a single communication system at one time.

One skilled in the art will appreciate that the adaptor module 100 may include any number and type of connectors 170 and 172. For example, the connectors 170 and 172 may comprise multiple pin interfaces with any number of desired pins such as 15, 26, or 36; Universal Serial Buses (USBs) that allow various peripheral devices to be connected to the adaptor module 100; various types of cable connectors; pass-through connectors; antennas for wireless or cellular communication; etc. These connectors, for instance, may be used to connect the adaptor 100 to various network and communication systems such as LANs, Ethernet, cellular, wireless, and the like. It will also be appreciated that the adaptor 100 may include any combination of connectors 170 and 172.

As shown in FIG. 13, the front surface 104 of the communication card 102 may include one or more connectors, ports or receiving portions 180. For example, the communication card 102 may include one or more RJ-type connectors, USBs and/or multiple pin interfaces. In particular, the communication card 102 shown in FIG. 13 includes a first connector 182 which is an RJ-type connector 184 such as an RJ-11 or RJ-45 type connector. The communication card 102 also includes a second connector 186 which is an I/O connector 188 such as a multiple pin interface or USB. It will be understood that the connectors 182 and 186 can be configured to interface with any desired communication systems and the adaptor 100 may include any number or combination of connectors. Thus, the user has a wide variety of options because the connectors 170 and 172 in the adaptor module 100 can be connected to various peripheral devices and communication systems. Additionally, the user can use the connectors 180 and 182 to connect the card 102 to various peripheral devices and communication systems. These connectors provide the user with increased flexibility and convenience. Accordingly, the adaptor module 100 and card 102 allow the user to perform a wide variety of desired functions.

Located within the adaptor module 100 is various circuitry, such as a printed circuit board, that allows the desired function to be performed. This circuitry can be used with various equipment such as modems, interfaces and antennas, which are discussed in more detail below. One skilled in the art will recognize the circuitry can be used in many different applications to perform many different functions. Preferably, the circuitry is recognized by the host computer and the computer can determine the configuration and capabilities of the adaptor module 100 and PC card 102.

Figure 14:
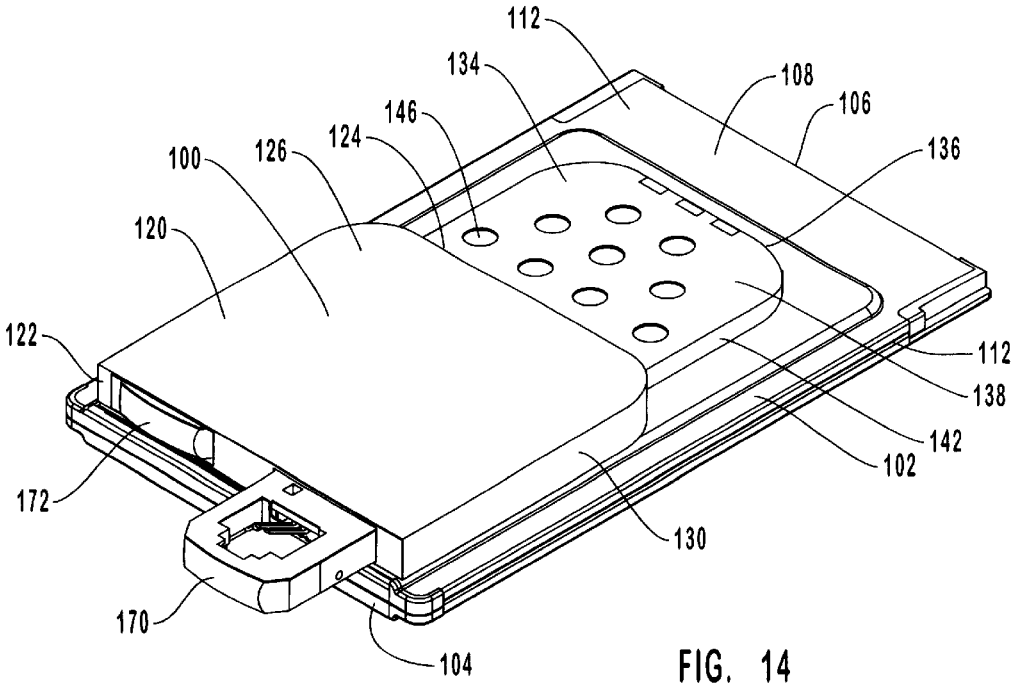
FIG. 14 is a perspective view of an adaptor module in accordance with yet another preferred embodiment of the present invention.

In another preferred embodiment, as shown in FIG. 14 the adaptor module 100 is integrally formed with the communication card 102. Thus, the adaptor module 100 and communication card 102 can be contained within a single housing or enclosure. Alternatively, the module 100 and card 102 can have separate enclosures, but the enclosures can be permanently attached to form a one-piece unit. The integral, one-piece arrangement is convenient and simple to use because the user does not have to attach the module 100 to the card 102.

Figure 15:
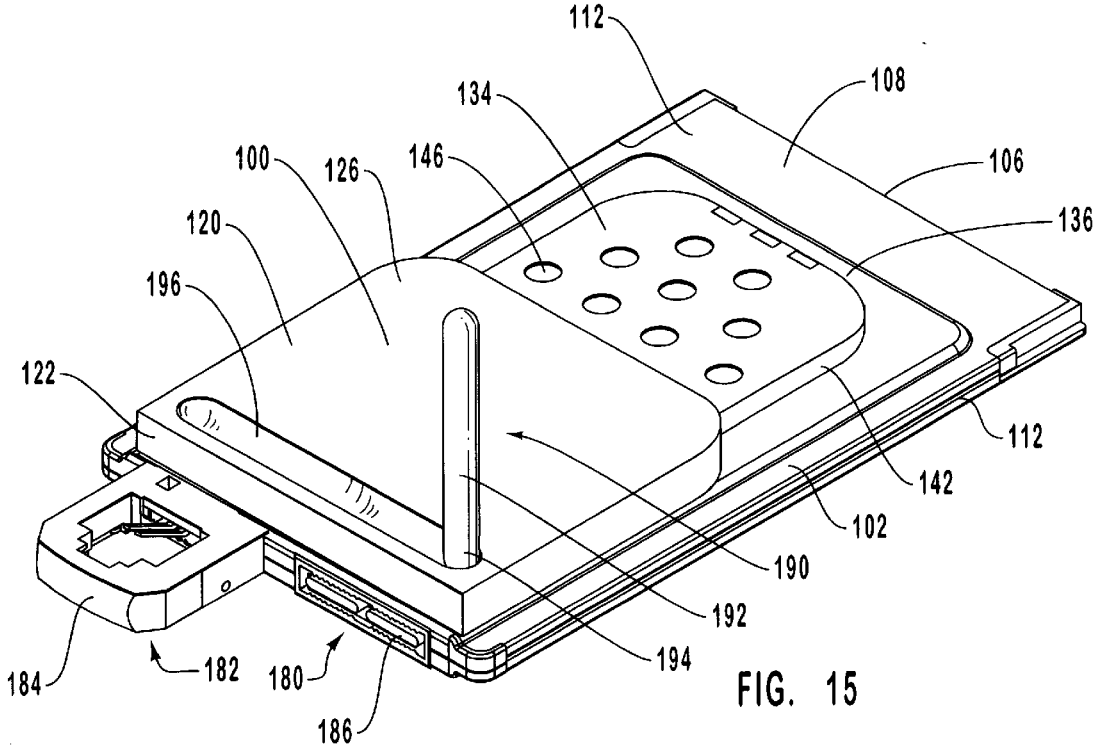
FIG. 15 is a perspective view of an adaptor module in accordance with still another preferred embodiment of the present invention.

As seen in FIG. 15, in another preferred embodiment, the adaptor module 100 includes an antenna system 190 that is configured to be in communication with a wireless communications network. The wireless network, for example, may include wireless modems, wireless LAN, wireless Personal Area Network (PAN), cellular telephone networks, digital communication systems, etc. The wireless network may also include Bluetooth technology that allows a wide range of computing and telecommunication devices to be interconnected via wireless connections. Specifications and other information regarding Bluetooth technology are available at the Bluetooth Internet web site www.bluetooth.com. Additionally, specifications and other information regarding Bluetooth technology will be published in the Bluetooth Special Interest Group (SIG) Version 1.0.

The antenna system 190 includes a monopole antenna 192, but any suitable type of antenna, such as dipole or slotted antenna, may also be used depending upon factors such as desired polarization and radiation patterns. Additionally, while the antenna system 190 may be used with any suitable wireless communication system, the antenna system is preferably configured to conform with applicable Bluetooth technology specifications and standards. For example, in accordance with the proposed Bluetooth standards, the antenna 192 is configured to use the Industrial Scientific and Medical (ISM) frequency band of 2.4 to 2.4835 gigahertz (GHz). One skilled in the art, however, will appreciate that the antenna 192 can be used with any suitable band or frequency depending, for example, upon the intended use of the antenna system 190.

In greater detail, the antenna 192 includes a radiating element (not shown in the accompanying figures) which is constructed of a flexible, metallic material that permits repeated bending or flexing of the antenna. The radiating element is preferably constructed of spring steel having the desired characteristics, but it may be constructed from other suitable materials such as copper or bronze. The radiating element is preferably plated wit a conductive material such as copper and the plating desirably has a thickness of at least about 0.0003 inches, but the plating may be thicker or thinner and other suitable conductive materials may be used. The antenna 192 also includes a protective sheath or covering 194 that substantially encloses the radiating element. The sheath 194 is constructed of a flexible, elastic material which allows the radiating element to bend or deflect into the desired configuration. The body 120 of the module 100 includes a recess or depression 196 to hold the antenna 192 when it is not in use and a latch (not shown) may be used to secure the antenna in a storage position. Additionally, the housing of the module 100 may contain support structure and various circuitry for the antenna, such al a radio frequency (RF) adaptor or circuit board. While the antenna 192 is preferably a minimum size and configured to be used with any desired wireless system, the antenna can have any size and configuration depending, for example, upon the desired use of the antenna system 190.

An exemplary antenna system 190 that may be used in conjunction with the adaptor module 100 is disclosed in Assignee's co-pending U.S. patent application Ser. No. 09/322,870, filed on May 28, 1999, entitled Antenna for Portable Computers, listing Madsen et al. as inventors, and this application is hereby incorporated by reference in its entirety. One skilled in the art will understand that other antennas and wireless communication systems may also be used with the adaptor module 100 of the present invention.

Figure 9:
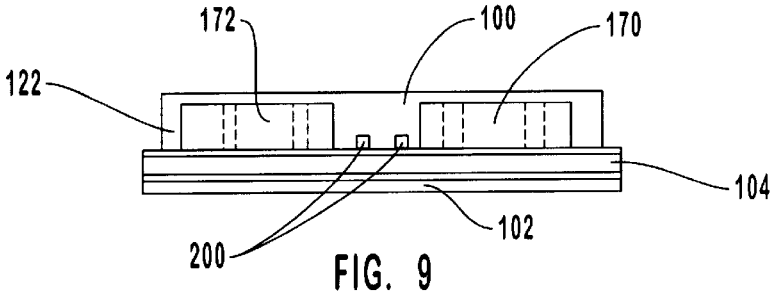
FIG. 9 is a front view of the adaptor module and PC card shown in FIG. 5, illustrating the exemplary connectors in the retracted position.
Figure 10:
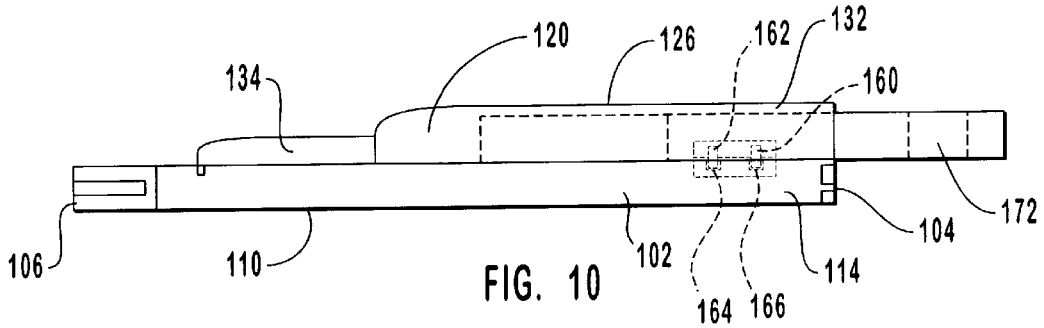
FIG. 10 is a left side view of the adaptor module and PC card shown in FIG. 5, illustrating the exemplary connector in the extended position.
Figure 11:
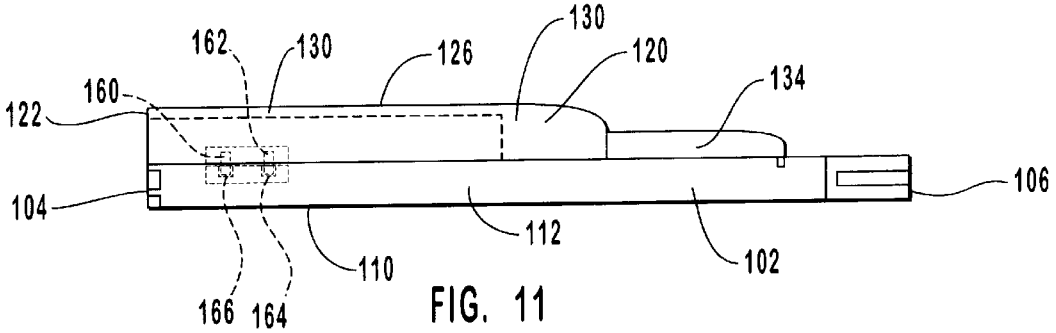
FIG. 11 is a right side view of the adaptor module and PC card shown in FIG. 5, illustrating the exemplary connectors in the retracted position.
Figure 12:
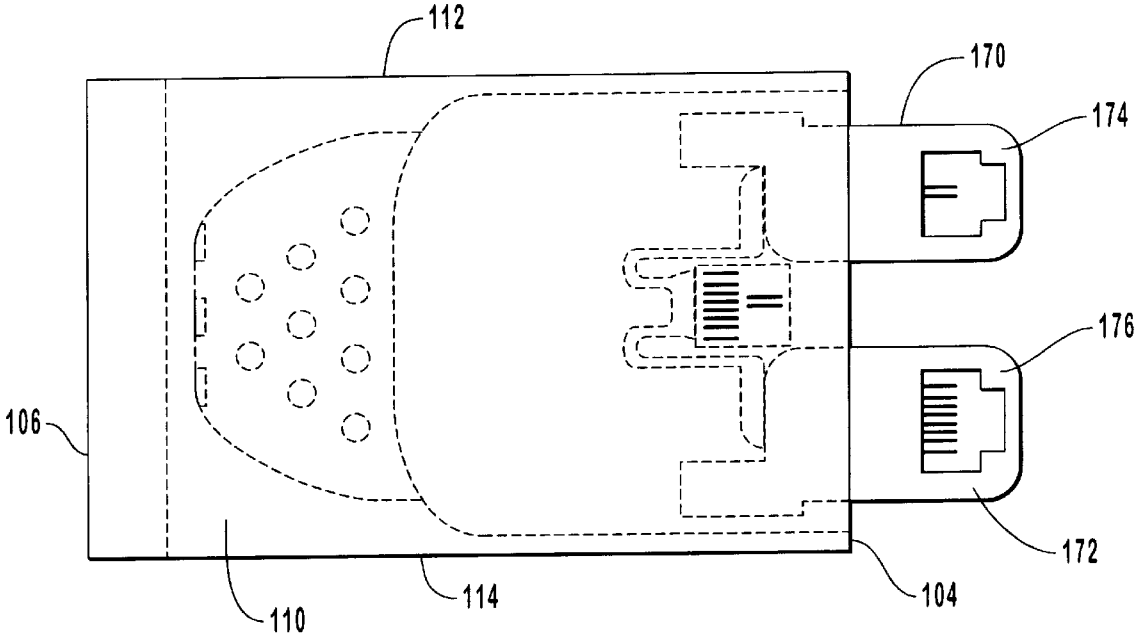
FIG. 12 is a bottom plan view of the adaptor module and PC card shown in FIG. 5, illustrating the exemplary connectors in the extended position.

As best seen in FIGS. 8 and 9, the adaptor module 100 includes one or more indicators 200 to provide information to the user. The indicators 200 are preferably light sources such as incandescent lights or light emitting diodes (LEDs). The indicators 200 may provide various information such as use of the adaptor module 100 and/or the mode of operation of the adaptor module. The indicators 200 may also be used for other purposes such as installation, set-up, diagnostics and repair of the adaptor module 100. The indicators 200, for example, may be electrically connected to the circuitry located within the module 100 or electrically connected to the card 102.

Figure 16:
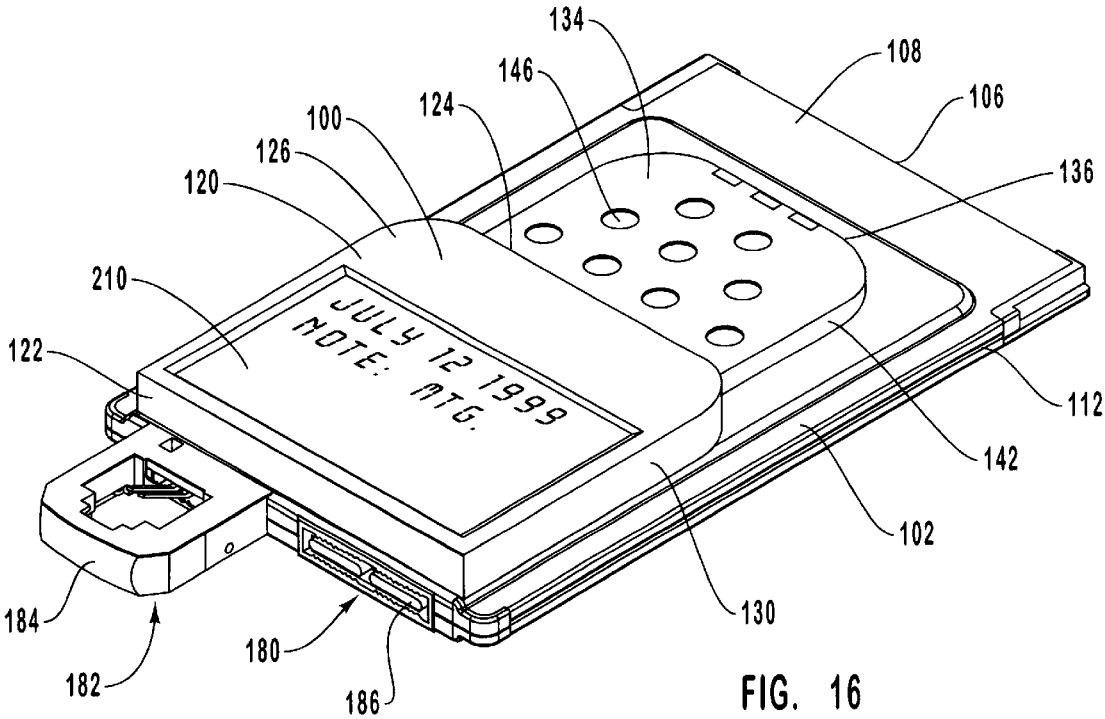
FIG. 16 is a perspective view of an adaptor module in accordance with a further preferred embodiment of the present invention.

As seen in FIG. 16, in another preferred embodiment, the body 120 of the adaptor module 100 includes a screen display 210. The screen display 210 is attached to the top surface 126 of the adaptor body 120 and it can provides information to the user, but the screen can be attached to any desired surface of the module 100 or card 102. The screen display is preferably a liquid crystal display (LCD), but any suitable type of display may be utilized. The screen display 210 may also include sensors or other known devices to allow the user to input information to the adaptor module 100.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A system that facilitates communication between an electrical device and a communication system, the system comprising:

a communication card including an elongated body having an outer surface with an upper surface, lower surface, front surface, rear surface, left surface and right surface, said communication card being sized and configured to be inserted into an opening in the electrical device;

a first communication port located in said generally planar outer surface of said communication card, said first communication port being aligned with the generally planar outer surface of the communication card such that the communication port does not protrude beyond the generally planar outer surface;

an adaptor module including an elongated body that is sized and configured to be inserted into an opening in the electrical device, said elongated body of said adaptor module having dimensions generally the same or smaller than dimensions of said elongated body of said communication card; and a second communication port located in a generally planar outer surface of said adaptor module, the second communication port being aligned with the generally planar outer surface of the adaptor module such that the communication port does not protrude beyond the generally planar outer surface, said second communication port being sized and configured to be coupled to said first communication port to allow electrical communication between said adaptor module and said communication card.

2. The system of claim 1, further comprising one or more receiving portions in said adaptor module capable of receiving a connector coupled to the communication system.

3. The system of claim 1, further comprising one or more receiving portions in said communication card capable of receiving a connector coupled to the communication system.

4. The system of claim 1, further comprising one or more receiving portions in said adaptor module capable of receiving a connector coupled to the communication system and one or more receiving portions in said communication card capable of receiving a connector coupled to the communication system.

5. The system of claim 4, wherein at least one of said receiving portions in said adaptor module includes a slidable member with an aperture that is sized and configured to receive a communication plug attached to the communication system.

6. The system of claim 1, wherein said first communication port is located in said upper surface of said communication card and said second communication port is located in said lower surface of said adaptor module.

7. The system of claim 1, further comprising one or more attachment members extending outwardly from an outer surface of said adaptor module and one or more corresponding apertures in said communication card, wherein said attachment members are sized and configured to be inserted into said apertures to attach said adaptor module to said communication card.

8. The system of claim 1, further comprising an antenna attached to said adaptor module and an antenna storage portion in said adaptor module, the antenna storage portion being sized and configured to store at least a portion of the antenna within the opening in the storage device, said antenna being configured to facilitate wireless communication between the electrical device and the communication system.

9. The system of claim 8, wherein the antenna is movable between a first position in which the antenna extends outwardly from the adaptor module and a second position in which the antenna is at least partially stored within the antenna storage portion.

10. The system of claim 1, further comprising a screen display attached to said adaptor module, the screen display being sized and configured to provide information to a user of the system, the screen display and the adaptor module being sized and configured to fit within the opening in the electrical device.

11. The system of claim 10, wherein the screen display is a liquid crystal display.

12. An adaptor module configured to be used in combination with a communication card for a portable electronic device, the communication card including a communication port located in a generally planar outer surface, the communication port being aligned with the generally planar outer surface such that the communication port does not protrude beyond the generally planar outer surface, said adaptor module comprising:

a body portion including said outer surface with an upper surface, lower surface, front surface, and rear surface, the lower surface being generally planar;

a communication port attached to said generally planar lower surface of said body portion, the communication port being aligned with said generally planar lower surface such that the communication port does not extend beyond said generally planar lower surface; and at least one connector attached to said front surface of said body portion, said connector being configured to be electronically coupled a communications connector;

wherein said communication port in said generally planar lower surface of said body portion is sized and configured to electrically communicate with the communication port in the generally planar outer surface of the communication card.

13. The adaptor module as in claim 12, wherein at least one of said two connectors attached to said front surface of said body portion includes a slidable member with an aperture that is sized and configured to receive the communications connector.

14. The adaptor module as in claim 12, further comprising an antenna attached to the adaptor module and a recess in the adaptor module, the antenna being sized and configured to be at least partially stored within the recess and within the opening in the electrical device.

15. The adaptor module as in claim 12 further comprising a screen display attached to said adaptor module, the screen display being sized and configured to fit within the opening in the electrical device.

16. An interface between a connector for a communication system and a communication card for an electrical device the communication card including a communication port located in a generally planar outer surface, the communication port being aligned with the generally planar outer surface such that the communication port does not protrude beyond the generally planar outer surface, said interface comprising:

an elongated body including said outer surface with a top surface, bottom surface, front surface, rear surface and side surfaces, the elongated body being sized and configured to be attached to the communication card, the elongated body and the communication card being sized and configured to fit within an opening in the electrical device, the elongated body including dimensions generally the same or smaller than the communication card;

a plurality of receiving portions located in said front surface of said body, each of said receiving portions being sized and configured to receive a communication connector;

a port in the bottom surface of said elongated body for electrically coupling the interface to the communication card, the bottom surface being generally planar and the port being aligned with the generally planar bottom surface such that it does not extend past the planar bottom surface; and a plurality of extensions extending outwardly from said elongated body, said extensions being sized and configured to attach the interface to the communication card.

17. The interface of claim 16, wherein said port is located in said bottom surface of said body, said port being configured to be electrically coupled to a port in an upper surface of the communication card.

18. The interface of claim 16, further comprising an antenna attached to said body and a recess in an outer surface of said body, said recess being sized and configured to receive at least a portion of said antenna in a storage position within the opening in the electrical device, said antenna being configured to allow wireless communication with a communication system.

19. The interface of claim 16, wherein said interface is configured to be releasably attached to the communication card.

20. The interface of claim 16, further comprising said communication card attached to said elongated body; and wherein said interface and said communication card are sized and configured to be inserted into a Type III PC card slot.

21. The interface of claim 16, further comprising a screen display attached to said elongated body, the screen display being sized and configured to fit within the opening in the electrical device.

* * * * *